US010205247B2

(12) United States Patent
Hong et al.

(10) Patent No.: US 10,205,247 B2
(45) Date of Patent: Feb. 12, 2019

(54) ANTENNA MODULES HAVING FERRITE SUBSTRATES

(71) Applicant: The Board of Trustees of the University of Alabama for and on behalf of the University of Alabama, Tuscaloosa, AL (US)

(72) Inventors: Yang-Ki Hong, Tuscaloosa, AL (US); Jae-Jin Lee, Tuscaloosa, AL (US)

(73) Assignee: The Board of Trustees of the University of Alabama for and on behalf of the University of Alabama, Tuscaloosa, AL (US)

( * ) Notice: Subject to any disclaimer, the term of this patent is extended or adjusted under 35 U.S.C. 154(b) by 0 days.

(21) Appl. No.: 14/770,741

(22) PCT Filed: Feb. 25, 2014

(86) PCT No.: PCT/US2014/018360

§ 371 (c)(1),
(2) Date: Aug. 26, 2015

(87) PCT Pub. No.: WO2014/134054

PCT Pub. Date: Sep. 4, 2014

(65) Prior Publication Data

US 2016/0013561 A1 Jan. 14, 2016

Related U.S. Application Data

(60) Provisional application No. 61/769,610, filed on Feb. 26, 2013.

(51) Int. Cl.

| | |
|---|---|
| ***H01Q 1/38*** | (2006.01) |
| ***H01Q 17/00*** | (2006.01) |
| ***H01Q 1/24*** | (2006.01) |
| ***H01Q 7/00*** | (2006.01) |

(52) U.S. Cl.
CPC ..... *H01Q 17/004* (2013.01); *H01Q 1/243* (2013.01); *H01Q 1/38* (2013.01); *H01Q 7/00* (2013.01)

(58) Field of Classification Search
CPC ..... H01Q 17/00
See application file for complete search history.

(56) References Cited

U.S. PATENT DOCUMENTS

| | | | |
|---|---|---|---|
| 5,327,148 | A | 7/1994 | How et al. |
| 5,502,451 | A | 3/1996 | Rainville et al. |
| 7,642,983 | B2 | 1/2010 | Davis |

(Continued)

OTHER PUBLICATIONS

Microstrip Antennas on Ferrites, 10th International Conference on Antennas and Propagation, Apr. 14-17, 1997, Conference Publication No. 436 IEE 1997.*

(Continued)

*Primary Examiner* — Andrea Lindgren Baltzell
(74) *Attorney, Agent, or Firm* — Maynard Cooper & Gale, P.C.; Jon E. Holland

(57) ABSTRACT

An antenna module (22) has an antenna (21) that is formed on a ferrite substrate (31), and the ferrite substrate is positioned within a small direct current (DC) magnetic field. The magnetic loss tangent of the ferrite is controlled by application of the small DC magnetic field, thereby improving antenna radiation efficiency and increasing the bandwidth of the antenna.

26 Claims, 8 Drawing Sheets

(56) References Cited

U.S. PATENT DOCUMENTS

| | | | | |
|---|---|---|---|---|
| 7,737,905 | B1 | 6/2010 | Meloling et al. | |
| 2008/0012779 | A1 | 1/2008 | Chen et al. | |
| 2008/0036671 | A1 | 2/2008 | Gonda et al. | |
| 2009/0146898 | A1* | 6/2009 | Akiho | H01Q 7/06 343/787 |
| 2011/0123727 | A1* | 5/2011 | Iorio | H01F 10/08 427/585 |
| 2012/0154234 | A1 | 6/2012 | Geiler et al. | |
| 2012/0237728 | A1* | 9/2012 | Kimura | C04B 35/265 428/141 |

OTHER PUBLICATIONS

Batchelor, et al., "Microstrip Antennas on Ferrites", 10th International Conference on Antennas and Propagation, Apr. 1997, Publication No. 436, pp. 1.30-1.33.

* cited by examiner

| $H$ (Oe) | tan $\delta_\mu$ | $f_r$ (MHz) | RE (dB) at $f_r$ | Peak gain (dBi) at $f_r$ |
|---|---|---|---|---|
| 0 | 0.044 | 201 | -18.0 | -16.5 |
| 100 | 0.025 | 211 | -15.9 | -14.0 |
| 200 | 0.008 | 227 | -12.4 | -10.5 |
| 400 | 0.001 | 250 | -9.2 | -7.1 |

*FIG. 8*

ANTENNA MODULES HAVING FERRITE SUBSTRATES

CROSS REFERENCE TO RELATED APPLICATION

This application claims priority to U.S. Provisional Patent Application No. 61/769,610, entitled "Antenna Modules having Ferrite Substrates" and filed on Feb. 26, 2013, which is incorporated herein by reference.

RELATED ART

In an effort to meet growing demands for increased data rates and reduced size for wireless communication devices, miniature and broadband antenna modules have been extensively investigated. High permittivity substrates have been used to help shorten the wavelength of the incident wave. However, the high permittivity of these substrates undesirably leads to an increase in capacitive energy storage. Therefore, the quality factor ($Q=2\omega W/P_{rad}$, where W is stored electric or magnetic energy and $P_{rad}$ is radiated power) of the antenna increases, thereby narrowing bandwidth.

Another approach is to use a folded, meandered, or spiraled radiator to increase the electrical length of the radiator. However, complicated radiator patterns tend to decrease antenna radiation efficiency.

In an effort to address such issues, the use of ferrite substrates in antenna modules has been studied because the ferrite material possesses both high relative permeability ($\mu_r$) and high relative permittivity ($\varepsilon_r$). Ferrite permeability increases the miniaturization factor of $(\mu_r\varepsilon_r)^{0.5}$ and the bandwidth of the antenna. However, there is a relatively high magnetic loss associated with the use of a ferrite substrate, thereby decreasing the radiation frequency of the antenna. Limiting the magnetic loss associated with the ferrite substrate is generally desirable for increasing the efficiency and performance of the antenna.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 8 is a table illustrating simulated performance of an antenna module, such as is depicted by FIG. 6.

FIG. 9(*b*) is a graph illustrating DC magnetic field dependence of 2D average gain versus frequency measured for antenna modules having ferrite substrates.

FIG. 10(*b*) is a graph illustrating DC magnetic field dependence of 2D average gain versus frequency measured for antenna modules having dielectric substrates.

DETAILED DESCRIPTION

The present disclosure generally pertains to antenna modules having ferrite substrates. In one exemplary embodiment, an antenna is formed on a ferrite substrate that is positioned within a small direct current (DC) magnetic field. The magnetic loss tangent of the ferrite is controlled by application of the small DC magnetic field, thereby improving antenna radiation efficiency and increasing the bandwidth of the antenna.

Figure 1:
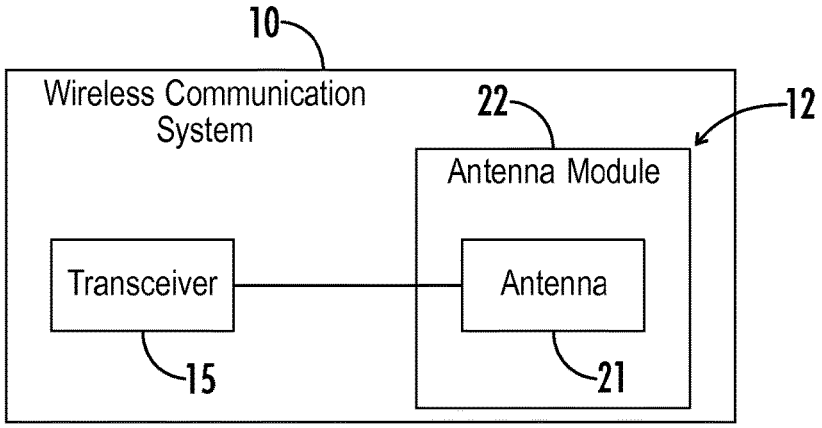
FIG. 1 is a block diagram illustrating an exemplary embodiment of a wireless communication system.

FIG. 1 depicts an exemplary embodiment of a wireless communication system 10, such as a cellular telephone, having an antenna module 12. Data to be transmitted from the system 10 is received by a transceiver 15, which is conductively coupled to an antenna 21 of an antenna module 22. The transceiver 15 forms an electrical signal based on the data, and transmits the electrical signal to the antenna 21. The signal's energy radiates wirelessly from the antenna 21 such that the signal is wirelessly communicated to at least one other remote device (not shown). A wireless signal transmitted to the system 10 is received by the antenna 21 and transmitted to the transceiver 15, which recovers data from such signal.

Figure 2:
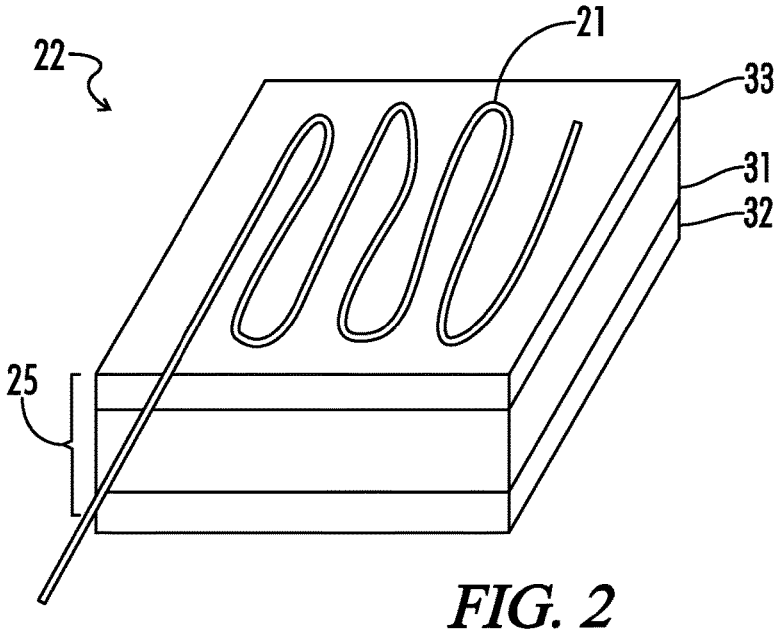
FIG. 2 depicts an exemplary embodiment of an antenna module, such as is depicted by FIG. 1.
Figure 3:
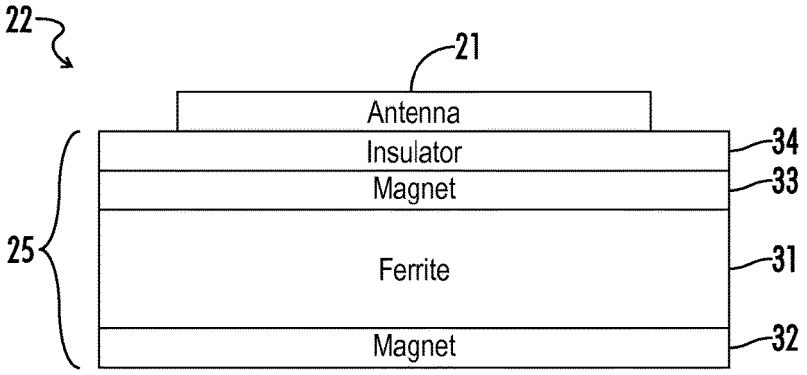
FIG. 3 is a side view illustrating the antenna module of FIG. 2.

FIGS. 2 and 3 depict an exemplary embodiment of the antenna module 22 depicted by FIG. 1. The module 22 comprises a substrate element 25 on which the antenna 21 is formed. As shown, the substrate element 25 comprises a ferrite substrate 31 for supporting other components of the module 22. In one exemplary embodiment, the substrate 31 is composed of $Ni_{0.5}Mn_{0.2}Co_{0.07}Fe_{2.23}O_4$, but other types of ferrite materials may be used. As an example, the substrate 31 may comprise spinel ferrites, such as Ni—Zn, Mn—Zn, Ni—Zn—Cu, Ni—Mn—Co, Co, Li—Zn, Li ferrites, or Mn ferrites. In addition, the substrate 31 may comprise hexagonal ferrites (e.g., M-, Y-, Z-, X-, or U-type), garnet, and ferrite composites. Yet other ferrite materials are possible in other embodiments.

The ferrite substrate 31 is sandwiched between two permanent magnets 32 and 33 that are composed of hard magnetic material. Each magnet 32 and 33 generates a magnetic flux that passes through the ferrite substrate 31. In one exemplary embodiment, each magnet 32 and 33 is composed of Nd—Fe—B, but other magnetic materials are possible in other embodiments. As an example, the magnets 32 and 33 may comprise Sm—Co, Fe—Pt, Co—Pt, Sm—Fe—N, Mn—Al, Mn—Bi, Ba hexaferrites, or Sr hexaferrites. Yet other magnetic materials are possible in other embodiments. In addition, each magnet 32 and 33 is formed as a thin film having a thickness of about 10 microns. Thin magnets 32 and 33 help to reduce the profile of the module 22, but the magnets 32 and 33 may have any thickness as may be desired.

As shown by FIG. 3, an electrical insulator 34 is formed on the magnet 33, and the antenna 21 is formed on the insulator 34. The insulator 34 electrically isolates the conductive antenna 21 from the magnet 33. In one exemplary embodiment, the insulator 34 is composed of $SiO_2$ or $Al_2O_3$, but other types of insulators may be used in other embodiments. Note that the layers 31-34 and/or the antenna 21 may be formed using conventional microfabrication techniques, though other techniques, including bulk fabrication, are possible as well. In addition, the insulator 34 is not shown in FIG. 2 for simplicity of illustration.

The permeability dispersion of the ferrite substrate 31 is generally related to two types of magnetizing processes, which are domain wall motion and spin rotation. Therefore, permeability spectra have both domain wall and spin resonances at a zero applied magnetic field. Domain wall resonance is associated with small-scale oscillating motion of domain walls, while spin resonance is related to the oscillating motion of electron spins. At the resonant frequencies, energy losses occur in the form of heat.

Contribution of domain wall motion to permeability dispersion can be reduced by applying a DC magnetic field to the ferrite substrate 31. Also, occurrence of both domain wall and spin resonances can be delayed toward higher frequency. Thus, application of a DC magnetic field to the ferrite substrate 31 reduces magnetic loss and pushes the resonance frequencies to higher frequencies. In the embodiment depicted by FIGS. 2 and 3, such DC magnetic field is generated by the permanent magnets 32 and 33. In other embodiments, other types of magnets can be used. As an example, it is possible to use bulk permanent magnets, electromagnets, solenoids, and other devices known to generate magnetic fields. When devices (e.g., electromagnets or solenoids) generating controllable magnetic fields are used, it is possible to control the magnetic flux passing through the ferrite substrate 31 using an electric current source as a control input. In this regard, a control circuit (not shown) may be used to control the magnetic flux as may be desired while signals are being communicated via the antenna 21.

Figure 4:
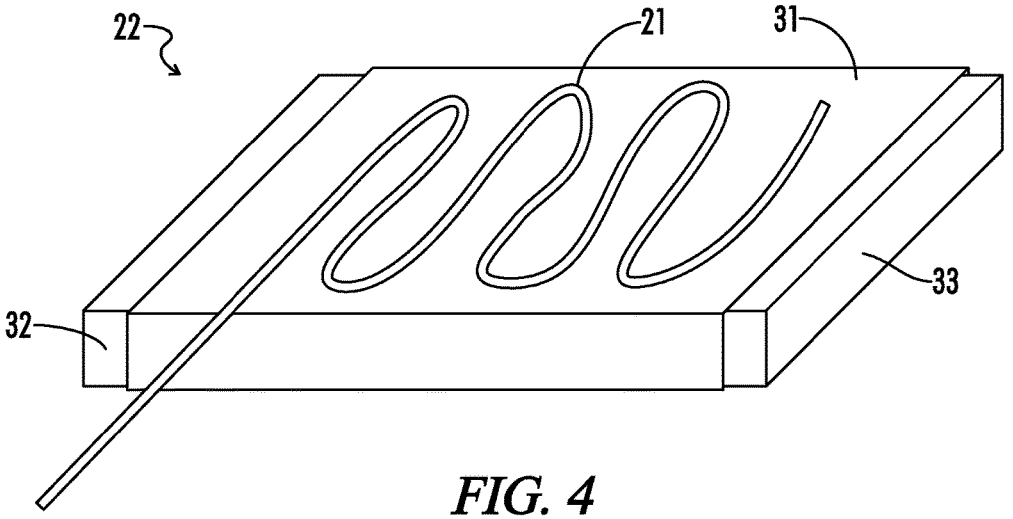
FIG. 4 depicts an exemplary embodiment of an antenna module, such as is depicted by FIG. 1.
Figure 5:
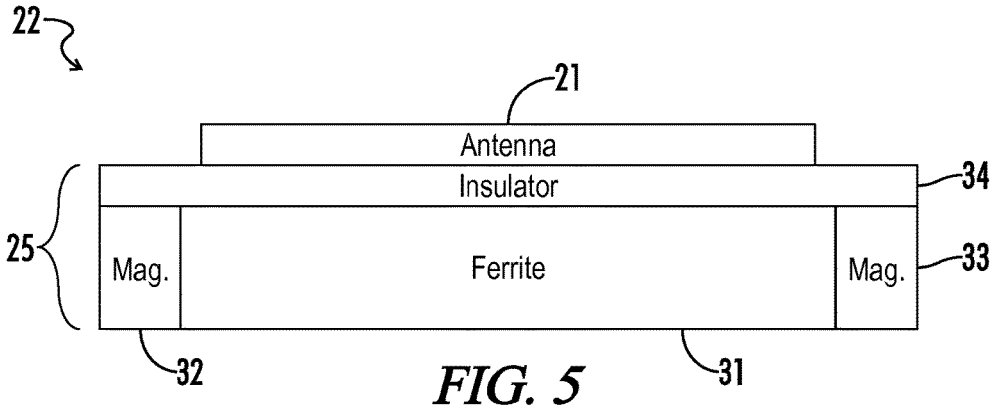
FIG. 5 is a side view illustrating the antenna module of FIG. 4.

FIGS. 4 and 5 depict another exemplary embodiment of the antenna module 22. The module 22 of FIGS. 4 and 5 is generally configured the same and operates the same as the module 22 of FIGS. 2 and 3 except that, in FIGS. 4 and 5, the magnets 32 and 33 are positioned on opposite vertical sides of the ferrite substrate 31. Thus, the magnetic field generated by the magnets 32 and 33 in FIGS. 2 and 3 is generally perpendicular to the ferrite substrate 31, whereas the magnetic field generated by the magnets 32 and 33 in FIGS. 4 and 5 is generally parallel with the ferrite substrate 31. Note that the insulator 34 is not shown in FIG. 4 for simplicity of illustration.

Figure 6:
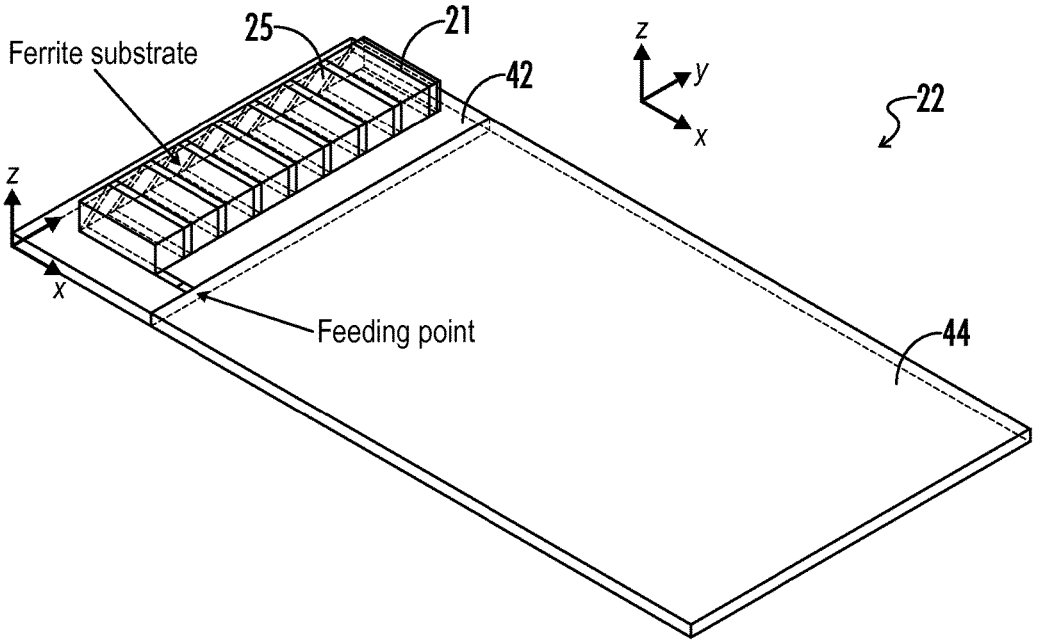
FIG. 6 depicts an exemplary embodiment of an antenna module.

FIG. 6 depicts an exemplary embodiment of an antenna module 22 having a substrate element 25, such as is depicted by FIG. 3 or 5, for example, formed on an electrically insulating substrate 42 juxtaposed with a conductive substrate 44 that forms a ground plane. In one exemplary embodiment, the insulating substrate 42 is composed of FR4, and the substrate 44 is composed of copper. However, other materials may be used in other embodiments. As shown by FIG. 6, the antenna 21 spirals around the substrate element 25.

Figure 7:
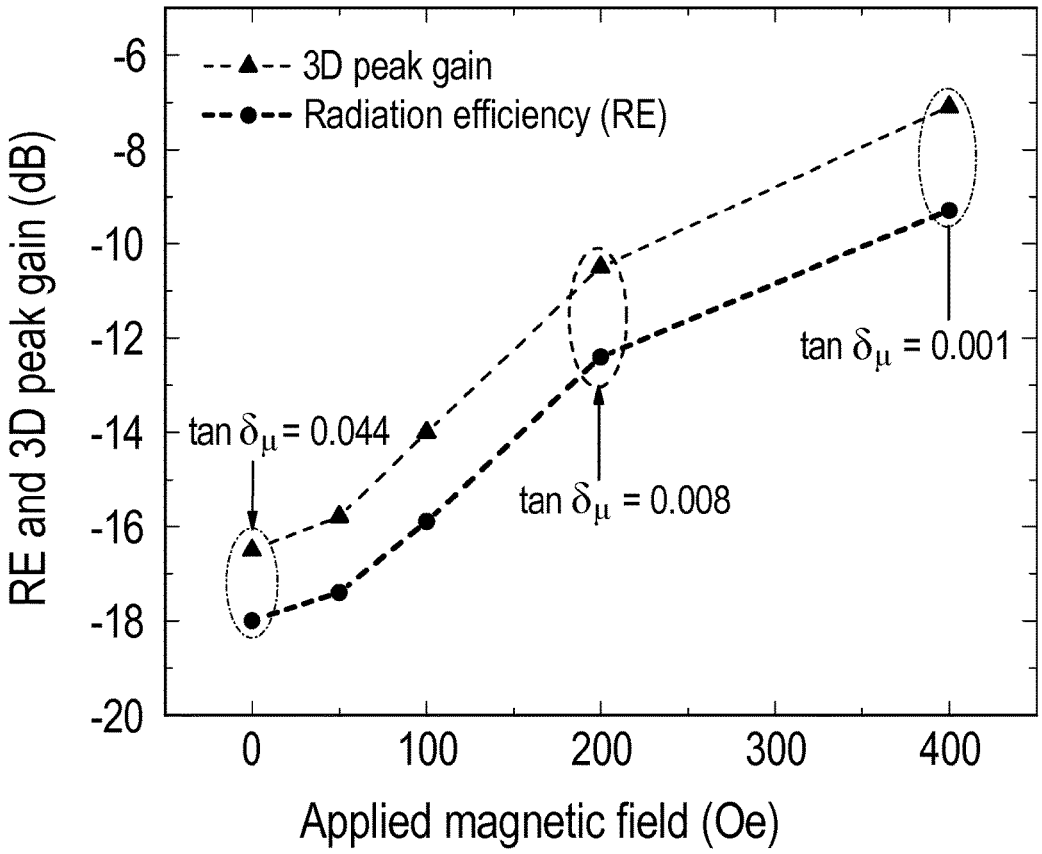
FIG. 7 is a graph illustrating radiation efficiency and three-dimensional (3D) peak gain versus applied magnetic field simulated for an antenna module, such as is depicted by FIG. 6.

Antenna radiation efficiency was simulated for the antenna module 22 depicted by FIG. 6. In this regard, FIG. 7 shows the DC magnetic field dependence of the radiation efficiency and gain at a given dielectric loss tangent. The radiation efficiency dramatically increased from about −18 decibels (dB) to about −9.2 dB as the magnetic field increased from zero to about 400 Oersted (Oe). This is attributed to a decrease in the magnetic loss tangent (tan $\delta_\mu$) with the applied DC magnetic field. Furthermore, three-dimensional peak gain of the antenna module 22 increased to about −7.1 dBi from about −16.5 dBi. The simulated ferrite antenna performance is summarized in the table depicted by FIG. 8.

Figure 9A:
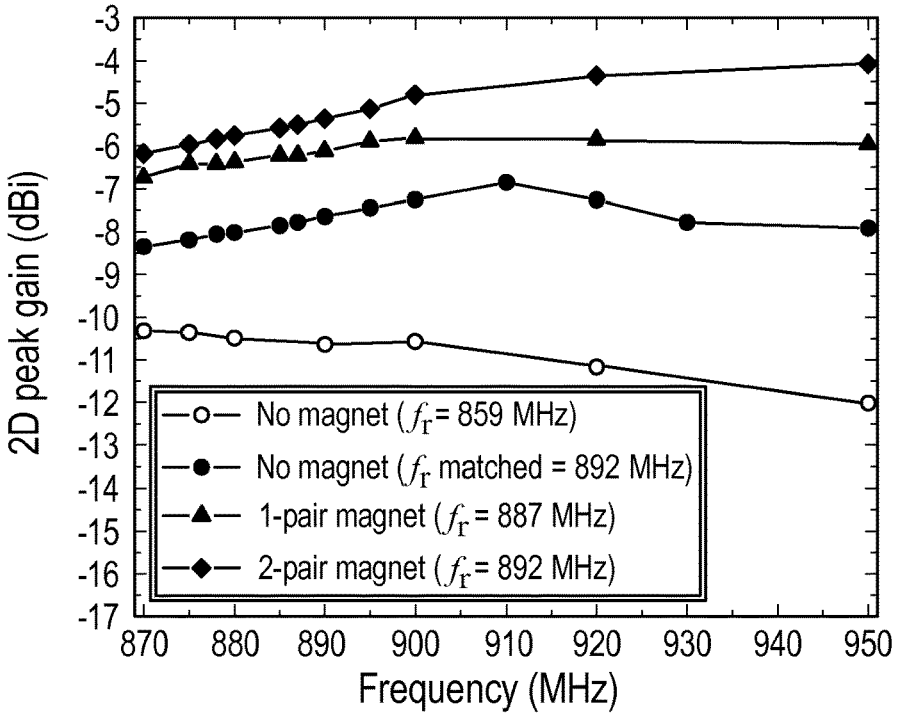
FIG. 9(*a*) is a graph illustrating DC magnetic field dependence of two-dimensional (2D) peak gain versus frequency measured for antenna modules having ferrite substrates.
Figure 9B:
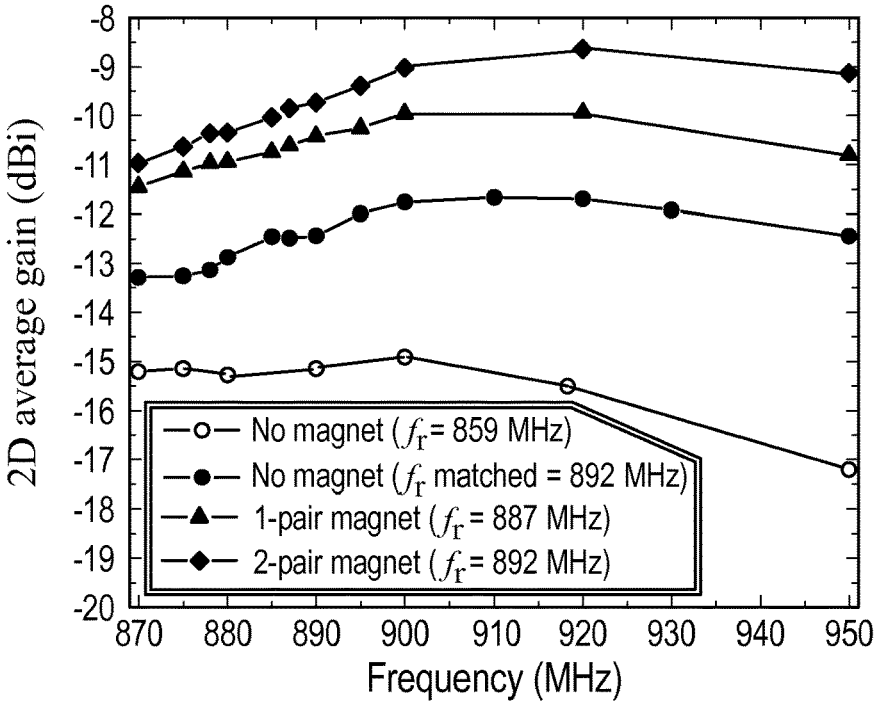
Figure 10A:
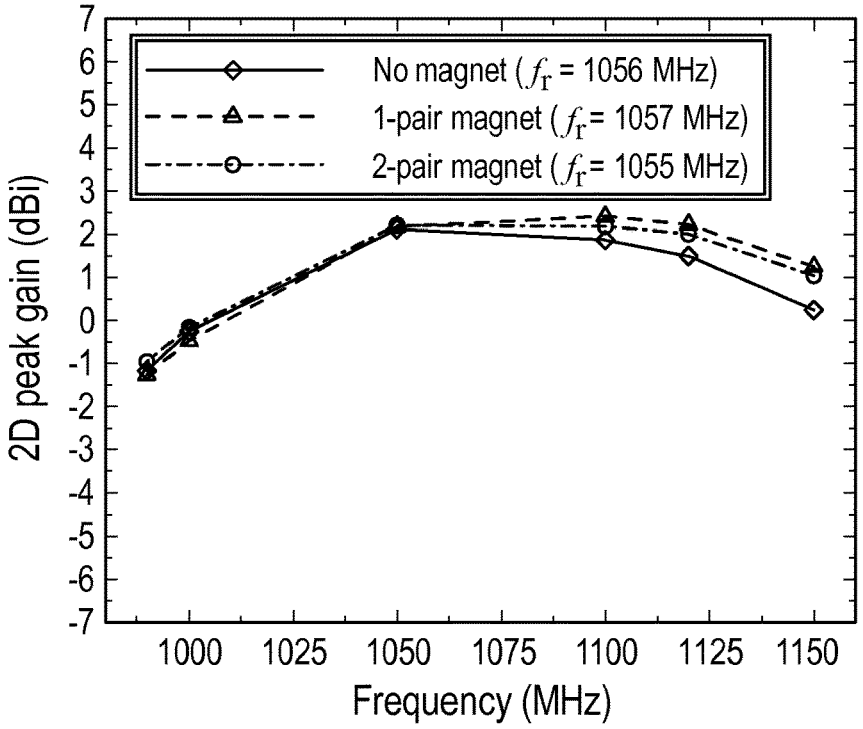
FIG. 10(*a*) is a graph illustrating DC magnetic field dependence of 2D peak gain versus frequency measured for antenna modules having dielectric substrates.
Figure 10B:
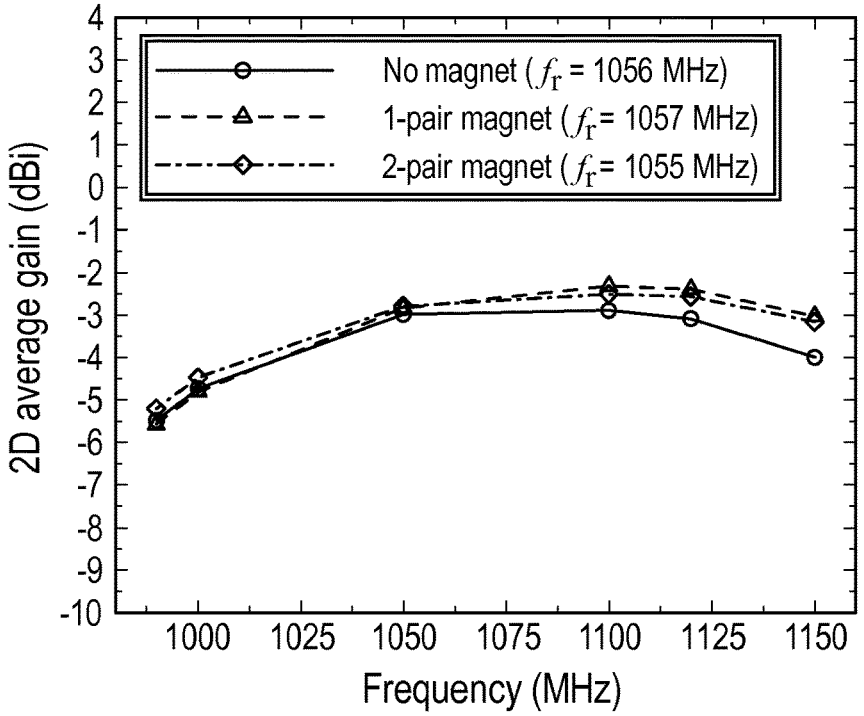

In other experiments, antenna modules 22 having soft $Ni_{0.5}Mn_{0.2}Co_{0.07}Fe_{2.23}O_4$ ferrite for the substrate 31 were tested both with Nd—Fe—B permanent magnets 32 and 33 and without such magnets 32 and 33. As a comparison, similar tests were performed on similar antenna modules having an FR4 substrate instead of a ferrite substrate 31 both with and without permanent magnets 32 and 33. The fabricated antenna modules were characterized by a network analyzer in an anechoic chamber for their performance. FIGS. 9 and 10 show measured two-dimensional peak and average gains for the ferrite and dielectric antenna modules, respectively. The gain of the ferrite antenna modules noticeably increased with the presence of the Nd—Fe—B permanent magnets, i.e., applied DC magnetic field. On the contrary, there is no noticeable increase in gain of the dielectric antenna module with the applied DC magnetic field.

Figure 11:
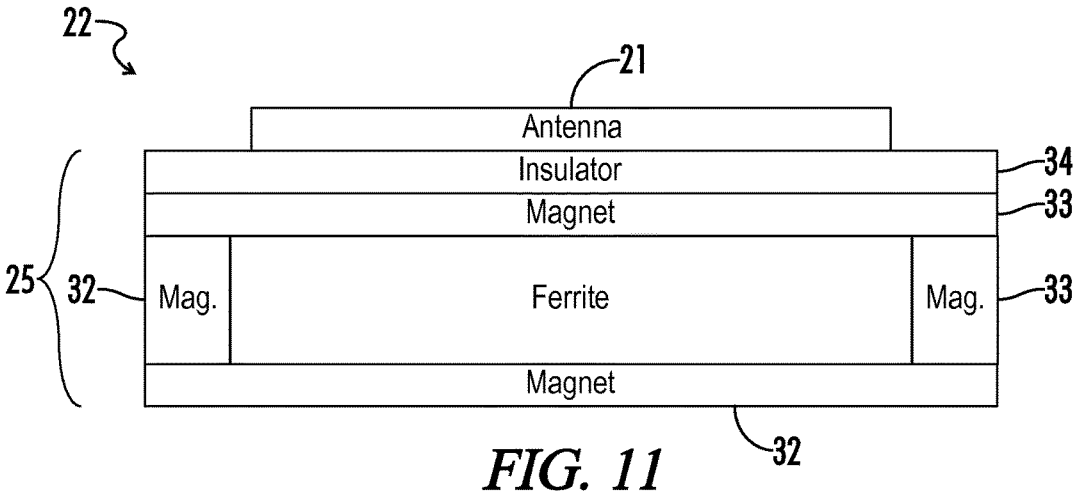
FIG. 11 is a side view illustrating an exemplary embodiment of an antenna module, such as is depicted by FIG. 1, having two pairs of magnets.

FIG. 11 shows another exemplary embodiment of an antenna module 22 that is essentially a combination of the embodiment shown by FIG. 3 and the embodiment shown by FIG. 5. In this regard, like the embodiment shown by FIG. 3, the antenna module 22 of FIG. 11 has a pair of magnets 32 and 33 positioned on a top side and a bottom side of the ferrite substrate 31. Also, like the embodiment shown by FIG. 5, the antenna module 22 of FIG. 11 has another pair of magnets 32 and 33 positioned on opposite vertical sides of the ferrite substrate 31. The presence of both pairs of magnets 32 and 33 (relative to the embodiments of FIGS. 3 and 5 where only one pair of magnets is shown) increases the magnetic flux passing through the ferrite substrate 31 and, hence, the radiation efficiency of the module 22. In this regard, a produced magnetic flux density is proportional to the volume of a magnet ($B=4\Pi M+H$), where B (Oe)=magnetic flux density, M (emu/cm$^3$)=magnetization, and H (Oe)=applied magnetic field). Thus, two pairs of magnets 32 and 33 produce greater magnetic flux density resulting in higher radiation efficiency and antenna gain.

It should be emphasized that the exemplary substrate elements 25 and/or techniques described herein are applicable to antenna modules of various types, including for example modules having chip antennas, patch antennas, PIFA antennas, FM antennas, mobile communication antennas, etc. It should be emphasized that the various embodiments described herein are exemplary. Various changes and modifications to the exemplary embodiments described herein would be apparent to a person of ordinary skill upon reading this disclosure.

Now, therefore, the following is claimed:

1. An antenna module, comprising:

an antenna substrate element having a ferrite substrate and one or more hard magnetic films, the one or more hard magnetic films comprising a hard magnetic material and positioned in contact with one or more sides of the ferrite substrate such that a magnetic flux generated by the one or more hard magnetic films passes through the ferrite substrate; and an antenna formed on the antenna substrate element.

2. The antenna module of claim 1, wherein the one or more hard magnetic films comprises a permanent magnet.

3. The antenna module of claim 1, wherein the hard magnetic material is selected from a group including: Sm—Co, Nd—Fe—B, Fe—Pt, Sm—Fe—N, Co—Pt, Mn—Al, Mn—Bi, Ba hexaferrites, Sr hexaferrites, and Al—Ni—Co.

4. The antenna module of claim 1, wherein the ferrite substrate comprises material selected from the group including: a spinel ferrite, hexagonal ferrite, garnet, and a ferrite composite.

5. The antenna module of claim 1, wherein the one or more hard magnetic films are between the ferrite substrate and the antenna.

6. The antenna module of claim 5, wherein the antenna substrate element has an insulator formed between the one or more hard magnetic films and the antenna.

7. The antenna module of claim 1, wherein the ferrite substrate has a first side and a second side opposite of the first side, and wherein the one or more hard magnetic films are formed on the first and second sides.

8. The antenna module of claim 7, wherein the ferrite substrate has a third side and a fourth side opposite of the third side, and wherein the one or more hard magnetic films are formed on the third and fourth sides.

9. The antenna module of claim 8, wherein the third and fourth sides are orthogonal to the first and second sides.

10. A method, comprising:

transmitting a signal to an antenna formed on an antenna substrate element having a ferrite substrate and one or more hard magnetic films, the one or more hard magnetic films comprising a hard magnetic material and positioned in contact with one or more sides of the ferrite substrate;

generating, via the one or more hard magnetic films, a magnetic flux that passes through the ferrite substrate; and wirelessly radiating the signal from the antenna during the generating.

11. The method of claim 10, wherein the one or more hard magnetic films comprises a permanent magnet.

12. The method of claim 10, wherein the hard magnetic material is selected from a group including: Sm—Co, Nd—Fe—B, Fe—Pt, Sm—Fe—N, Co—Pt, Mn—Al, Mn—Bi, Ba hexaferrites, Sr hexaferrites, and Al—Ni—Co.

13. The method of claim 10, wherein the ferrite substrate comprises material selected from the group including: a spinel ferrite, hexagonal ferrite, garnet, and a ferrite composite.

14. The method of claim 10, wherein the one or more hard magnetic films are between the ferrite substrate and the antenna.

15. The method of claim 14, wherein the antenna substrate element has an insulator formed between the one or more hard magnetic films and the antenna.

16. The method of claim 10, wherein the ferrite substrate has a first side and a second side opposite of the first side, and wherein the one or more hard magnetic films are formed on the first and second sides.

17. The method of claim 16, wherein the ferrite substrate has a third side and a fourth side opposite of the third side, and wherein the one or more hard magnetic films are formed on the third and fourth sides.

18. The method of claim 17, wherein the third and fourth sides are orthogonal to the first and second sides.

19. The method of claim 10, wherein the one or more hard magnetic films each has a thickness less than 1 mm.

20. The method of claim 10, wherein the antenna substrate element further comprises an insulator.

21. The antenna module of claim 1, wherein the one or more hard magnetic films each has a thickness less than 1 mm.

22. The antenna module of claim 1, wherein the antenna substrate element further comprises an insulator.

23. An antenna module, comprising:

an antenna substrate element comprising:

a ferrite substrate; and a pair of permanent magnets positioned in contact with the ferrite substrate, the pair of permanent magnets being located on opposed sides of the ferrite substrate and comprising a hard magnetic material, wherein a DC magnetic field generated by the pair of permanent magnets passes through the ferrite substrate; and an antenna formed on the antenna substrate element.

24. The antenna module of claim 23, wherein the pair of permanent magnets each comprise a hard magnetic film.

25. The antenna module of claim 23, wherein the pair of permanent magnets is a first pair of permanent magnets and the antenna module further comprises a second pair of permanent magnets positioned in contact with the ferrite substrate, the second pair of permanent magnets being located on opposed sides of the ferrite substrate perpendicular to the first pair of permanent magnets.

26. The antenna module of claim 23, wherein the DC magnetic field from the pair of permanent magnets controls a magnetic loss tangent of the ferrite substrate.

* * * * *